United States Patent [19]

Deprez et al.

[11] 4,154,060

[45] May 15, 1979

[54] METHOD FOR STARTING A PRESSURE-CHARGED INTERNAL-COMBUSTION ENGINE AND APPARATUS FOR IMPLEMENTING THE METHOD

[75] Inventors: Alain Deprez, Merelbeke, Belgium; Reinhard Fried, Nussbaumen, Switzerland

[73] Assignee: BBC Brown Boveri & Company Limited, Baden, Switzerland

[21] Appl. No.: 751,098

[22] Filed: Dec. 16, 1976

[30] Foreign Application Priority Data

Dec. 31, 1975 [CH] Switzerland ..... 16933/75

[51] Int. Cl.[2] ..... F02B 33/44

[52] U.S. Cl. ..... 60/611; 123/179 A

[58] Field of Search ..... 60/600, 611; 123/119 C, 123/179 A

[56] References Cited

U.S. PATENT DOCUMENTS

| | | | |
|---|---|---|---|
| 2,283,694 | 5/1942 | Perrine | 123/119 C |
| 2,645,409 | 7/1953 | Lawler | 60/600 |
| 2,853,987 | 9/1958 | Berchtold et al. | 123/119 C |
| 2,958,405 | 11/1960 | Glamann | 123/119 C |
| 3,018,617 | 1/1962 | Kelgard | 60/611 |
| 3,020,901 | 2/1962 | Cook | 123/119 C |
| 3,049,865 | 8/1962 | Drayer | 60/611 |
| 3,180,330 | 4/1965 | Barnes | 123/119 C |
| 3,651,636 | 3/1972 | Glassy et al. | 60/611 |

*Primary Examiner*—Charles J. Myhre
*Assistant Examiner*—David D. Reynolds
*Attorney, Agent, or Firm*—Burns, Doane, Swecker & Mathis

[57] ABSTRACT

A starting arrangement for a pressure-charged internal-combustion engine in which at the beginning of the starting phase combustion air is delivered to the engine by way of a bypass valve and a throttle valve in the charge-air line from the pressure-charging device is closed. Two mutually independent variables are used for controlling the opening of the throttle valve. At the end of the starting phase a command variable typical of the process e.g., charge air pressure is used to initiate an opening of the throttle valve and an engine-dependent operating variable e.g., engine lubricating oil pressure is then used to actually move the throttle valve to its open position, the throttle valve then remaining in the open position so long as the engine-dependent operating variable does not fall below a specified minimum value.

13 Claims, 3 Drawing Figures

METHOD FOR STARTING A PRESSURE-CHARGED INTERNAL-COMBUSTION ENGINE AND APPARATUS FOR IMPLEMENTING THE METHOD

The invention concerns a method for starting a pressure-charged internal-combustion engine which at the beginning of the starting phase receives the combustion air via a bypass valve and during this time a throttle valve in a charge-air line from a pressure-charging device to the engine is closed, the invention also concerning apparatus for implementing the method.

With pressure-charged internal-combustion engines, starting presents certain difficulties, as also does running at low partial loads. In the lower speed ranges an exhaust-gas turbocharger supplies too little combustion air, and so the engine has to aspirate the necessary air itself or else receives only an insufficient quantity, the result of which being poor combustion. When a gas-dynamic pressure-wave machine is used as the pressure-charging device, excessive recirculation of exhaust gases occurs in the lowest speed ranges, i.e., too much exhaust gas passes into the combustion air, whereupon the engine can be started only with difficulty, or not at all.

A remedy has been found by providing a throttle valve in the charge-air line from the pressure-charging device to the engine which is closed during starting, for example, together with a bypass valve through which the engine, during starting, aspirates combustion air direct from the surroundings. The throttle valve can be operated automatically.

Thus a method is known, U.S. Pat. No. 2,853,987, whereby in an engine charged by a pressure-wave machine the bypass valve and the throttle valve are actuated alternately by an operating variable, for example the pressure difference between the compressed combustion air and the engine exhaust gases flowing to the pressure-wave machine. Such a concept of automatic control is not realistic because already at half-load and below, this pressure difference becomes negative over the whole speed range. The pressure-wave machine would then be inoperative and the engine would function merely as a naturally aspirating engine.

A further disadvantage when the throttle valve is actuated by the pressure difference, and also when it is actuated by the air pressure alone, by the pressure or temperature of the engine exhaust gases, or by the travel of the injection pump governor rod, etc., is that control of this kind results in irritating chattering of the throttle valve. In the case of a vehicle diesel engine, for example, the load, speed and exhaust temperature are continually varying, and hence also the control variables stated are changing constantly, which acts directly on the control device in that it is ceaselessly opening and closing.

An engine pressure-charged by a pressure-wave machine is also known, Swiss Pat. No. 399,077, which during starting receives combustion air from a branch line which remains closed in normal operation. A throttle valve in the charge-air line is closed by the starter motor current during starting, and opens again as soon as the starter is no longer in operation. A control system of this kind, however does not have a reasonable timing element. At very low intake temperatures the valve should not begin to open for approximately 60 to 90 sec., i.e., after the gas temperature before the pressure-wave machine has reached about 100° C. However, the starter cannot be operated for 60 sec, let alone 90 sec.

The object of the invention is to open the throttle valve automatically at the right moment after starting, i.e., without impairing the running of the engine, and to match the timing element in the control loop to the typical cold-starting characteristics of the engine.

This object is achieved in that opening of the throttle valve at the end of the starting phase is initiated by a command variable typical of the process, or by a pulse of this variable, and actuation of the throttle valve is effected by an operating variable which is dependent on the engine and after the starting phase does not fall below a specified minimum value.

Apparatus for implementing this method incorporates a control device on which the command variable typical of the process acts via a control line and which by acting on a final control element causes the throttle valve to be actuated by the operating variable dependent on the engine.

The advantage of this method lies in the use of two mutually independent variables, the action of the one for actuating the throttle valve being triggered by the other. By separating the two functions in this way it is possible to set the effective threshold of each variable individually, thus allowing a wider range of application and specific adaptation to the whole process. An operating sequence for the throttle valve made possible in this way can be matched finely and dependably to the particular characteristics of the engine in the starting phase.

In an alternative form of the invention, the throttle valve (if it is closed in its rest position, which need not necessarily be so) can be held open while the engine is running by the same variable which causes it to open, and not close until this variable falls below the specified minimum value, which can be set so that values below the minimum occur only when the engine is stopped. The result of this is that the throttle valve remains open under all operating conditions and also when the engine is idling, and thus causes no disturbing noise.

In the drawings,

FIG. 1 shows a basic flow diagram, while

Figure 1:
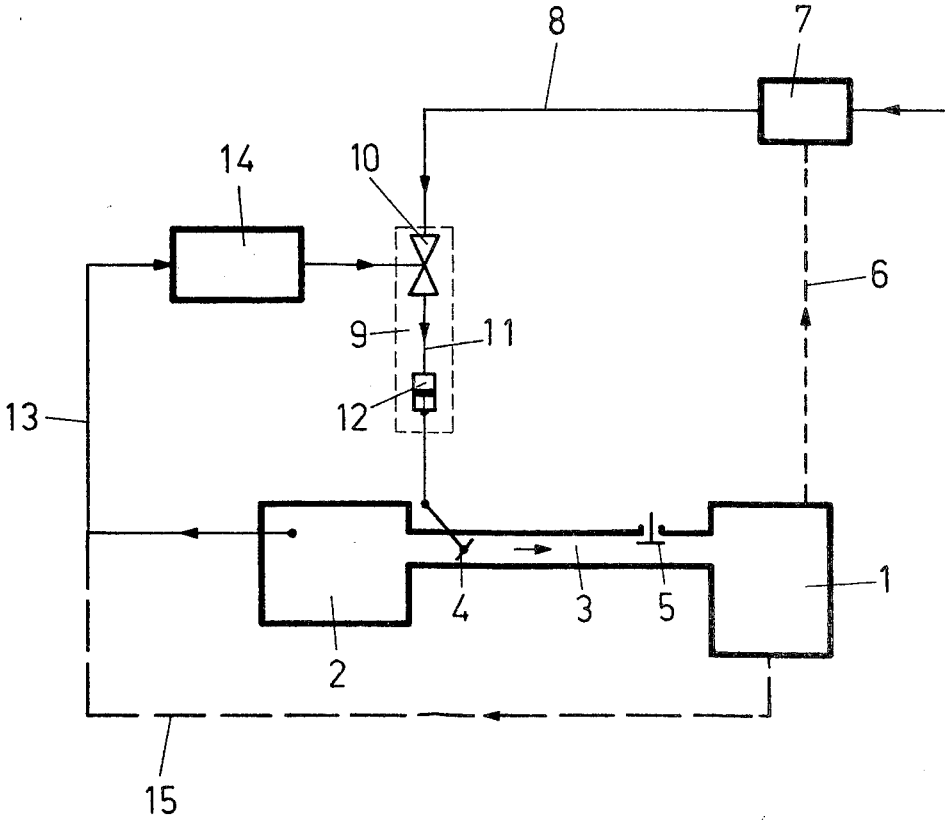

According to FIG. 1, the internal-combustion engine 1 is charged by the pressure-charging device 2 via the charge-air line 3. The throttle valve 4 and bypass valve 5 are located in the charge-air line. From the engine 1 an active line 6 leads to valve 7 provided in the supply line 8 for an actuating medium. The supply line 8 ends at final control element 9 which incorporates a switching device 10 that blocks or releases the flow of actuating medium to the connecting line 11 and further to the actuating device 12, which is also a part of the final control element 9 and actuates the throttle valve 4.

The control line 13 leads from the pressure-charging device 2 to the controller 14, which acts on the switching device 10. The control lines 15, 13 can also lead to the controller 14 from the engine 1, instead of from the pressure-charging device.

This arrangement functions in the following manner. An engine-dependent operating variable which occurs only when the engine is running opens valve 7 via active line 6, whereupon the actuating medium is free to flow via supply line 8 as far as the control element 9, but switching device 10 prevents it from passing through. Not until a command variable (typical of the process) coming from the engine 1 or from the pressure-charging device 2, and acting on the controller 14 via control line 13, has attained a specified, adjustable value does the controller 14 change the state of the switching device 10, which then allows the actuating medium to pass through. The previously closed throttle valve 4 is opened by the actuating device 12, and remains in this position. As will be explained below with reference to FIG. 2, the switching device 10 can be held in the open position directly by the engine-dependent operating variable, or indirectly by this same variable.

The bypass valve 5, which is opened only by the airflow induced by the running engine, closes again automatically as soon as compressed air flows through the open throttle valve to the engine.

The valve 7 is held open by an engine-dependent operating variable which after the starting phase, i.e., during operating, does not fall below a specified minimum valve. The latter is so chosen that values below the minimum occur only when the engine is stopped. In this case, valve 7 shuts off the flow. It is preferably so designed that it then not only seals off the actuating medium, but at the same time opens a drain for lines 8 and 11, which are still under pressure. Releasing the pressure causes the actuating device 12 to close the throttle valve 4, and the switching device 10 returns to its original state, blocking the flow of the actuating medium.

An actuating medium characteristic of the engine can be used instead of one dissociated from the engine, in which case valve 7 is superfluous.

Examples of liquid or gaseous actuating media are: engine lubricating oil, hydraulic oil, cooling or external water, brake air not coming from the tank, and operating air in the case of construction machines. Examples of engine-dependent operating variables include: pressure of engine lubricating oil, operating hydraulics or cooling water, pressure of steering hydraulics or from a converter, brake-air pressure, operating-air pressure, current of battery, starter or generator.

The use of an actuating medium can also be combined with an electrical device. It can be of advantage, for example, to make the actuating medium operate an electrical pressure switch which alters the setting of the throttle valve. Examples of actuating devices are then: hydraulic or pneumatic cylinder, linear-piston motor, rotary piston, tilting piston, window valve, bellows, diaphragm, geared electric motor, rotary or linear magnet, spindle mechanism driven by an electric motor.

Examples of command variables typical of the process are: charge-air pressure, gas pressure before the charging device, the difference between these two pressures, engine exhaust-gas temperature, speed of engine or charging device, centrifugal force due to speed, travel of the injection pump governor rod, and pulses of these variables.

These command variables can act, for example, on the following corresponding controllers: pulse, pressure, temperature or rotational-speed switches, solenoid, slide valve, rotary slide valve, relay.

Figure 2:
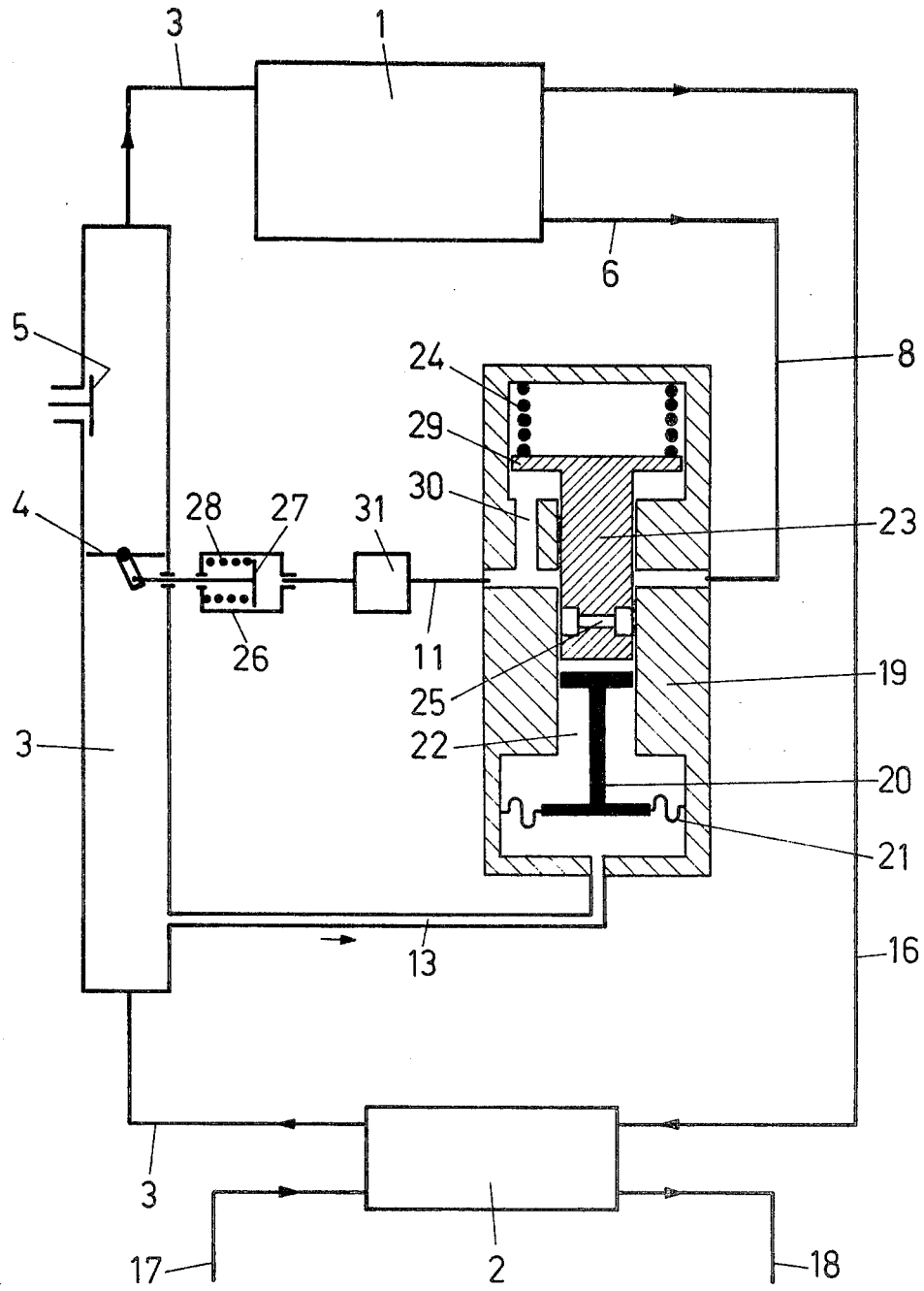
FIG. 2 illustrates an example of the invention, partly schematic and partly as a section through a simplified construction.
Figure 3:
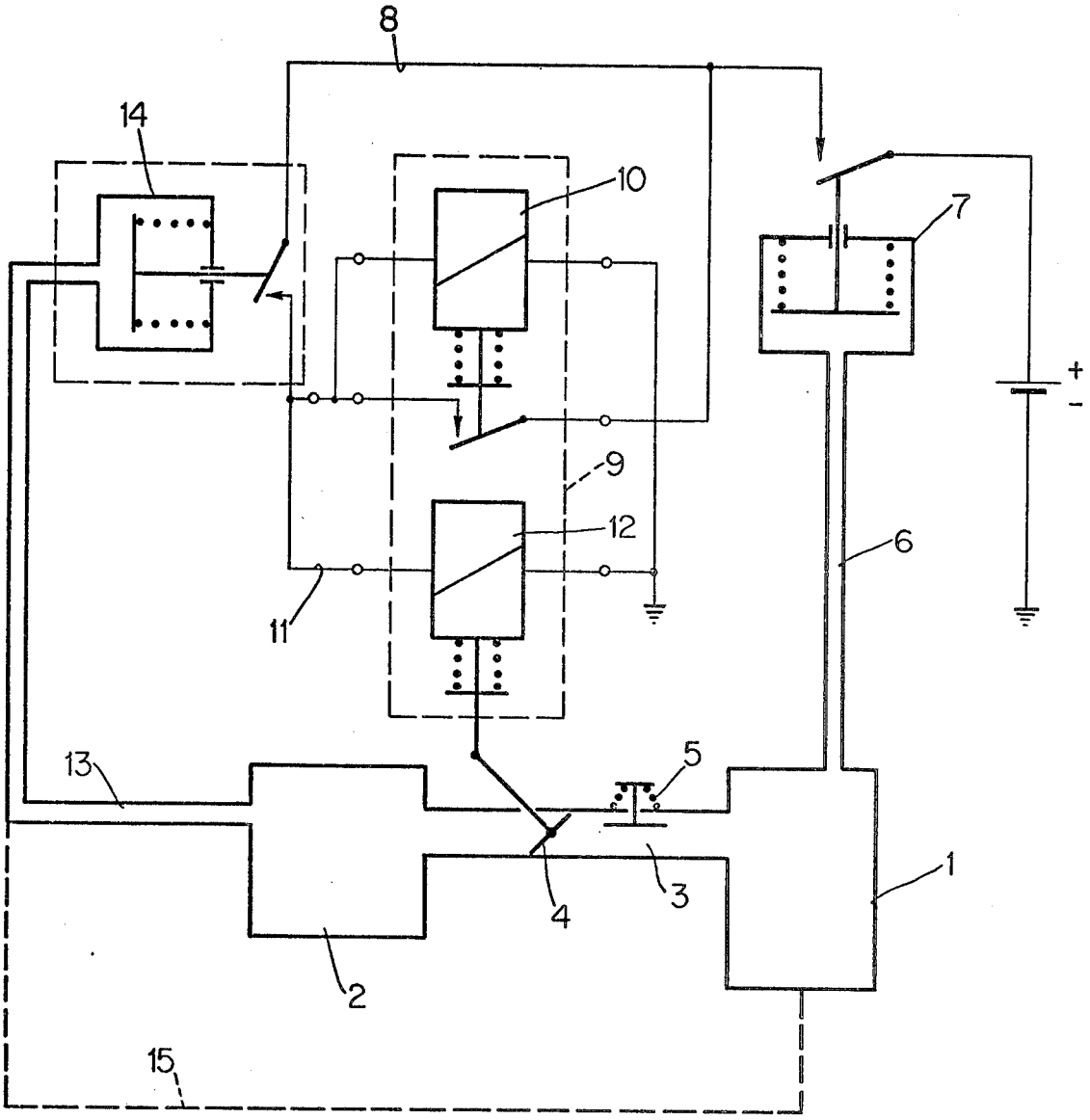
FIG. 3 is a schematic illustration of an example of the invention having an electrical structure. The reference symbols are the same in all three figures.

One of the many possible configurations is shown in FIG. 2. The charging device 2 is a gas dynamic pressure-wave machine which pressure-charges the engine 1 via the charge-air line 3. The pressure-wave machine receives the engine exhaust gases via line 16, and the air to be compressed via line 17, the exhaust gas, after giving up energy, leaving via line 18. The bypass valve 5 is located in the charge-air line 3 directly after the throttle valve 4, when viewed in the direction of the flow.

The supply line 8 for the engine lubricating oil, which in the present case adjoins the active line 6 and also performs the function of the latter, leads from the engine to the housing 19 which contains the controller and a part of the final control element. The controller incorporates essentially the positioning device 20, which is held by the resilient diaphragm 21 and extends into the bore 22 of the housing 19. The pressure in the charge-air line 3, serving as a command variable typical of the process, acts via control line 13 on the underside of the positioning device 20 and diaphragm 21. If the positioning device 20 is moved, it in turn moves the switching device, comprising the piston 23 located in bore 22, against the force of spring 24. When the movement of piston 23 is sufficiently large, duct 25 in the piston establishes communication between supply line 8 and line 11 connecting to the actuating device. This is here in the form of pressure cylinder 26 on the piston 27 of which the engine lubricating oil acts directly as an engine-dependent operating variable. The piston 27 is in this way displaced against the force of spring 28—to the left in the drawing—and opens the throttle valve 4.

The controller, and in particular the diaphragm 21, is of such dimensions that it responds only when the pressure in the charge-air line 3 is higher than that obtained at the so-called slow idling speed. This is necessary because the throttle valve would otherwise open during the starting phase (by which is meant the time from the commencement of starting up to and including slow idling from cold). However, the valve must not open until the command variable, in this case the charge-air pressure, rises further, this being achieved by increasing engine speed, e.g., by accelerating at no-load, or by loading the engine.

In varying operation on it repeatedly happens that engine speed is reduced to slow idling. So that the piston 23 cannot then retract and close the throttle valve 4 again, the piston is mechanically joined to the holding device 29, on one side of which the pressure in the connecting line 11 acts via duct 30, this pressure being counteracted on the other side by the force of spring 24. This ensures that an effective link is continuously maintained from the engine up to the actuating device for the throttle valve. It is understood that a port in the piston 23 or a connection outside the housing 19 can be provided instead of duct 30.

The actuating device is adjusted so that it holds the throttle valve open so long as the engine-dependent operating variable does not fall below a specified minimum value, and this minimum is so chosen that lower values do not occur even when the engine is idling. In this way, annoying chattering of the throttle valve is prevented even with continually changing operating conditions as occur, for example, with a vehicle engine.

If the engine is stopped, the lubricating oil pressure falls below the specified mininum value. The spring 28 expels the lubricating oil present in the pressure cylinder 26, and in so doing closes the throttle valve 4. The pressure in the charge-air line 3 also falls, whereupon the pressure on the positioning device 20 decreases and it is reset by the restoring force of the diaphragm 21 or by the spring 24, together with the piston 23.

If, as in the present example, the engine lubricating oil is the actuating medium, it can take a long time, especially in cold weather, before the lubricating oil has run back after stopping the engine. So that the piston 23 does not close the flow off again prematurely, the spring 24 can be made weak so that it comes into action only if the pressure falls very sharply on the other side of the holding device 29. Despite this, it could happen that through closing off the return flow of actuating medium too quickly, the throttle valve is not completely closed, or that the release of pressure in lines 8 and 11 occurs too slowly. In these cases the rapid vent valve 31 in connecting line 11 can be of advantage.

It should also be noted that it has hitherto been implicitly assumed that the throttle valve is closed in the rest position and during operation is held open in the manner described, or a similar manner. The present method, however, can equally be applied if the throttle valve is open in the rest position, and closed only in the starting phase. It can, for example, be closed simultaneously with connection of the starter current, and return to its open rest position only when the command variable typical of the process initiates actuation of the throttle valve by means of the engine-dependent operating variable.

It can also be of benefit if the control facility is in the form of an electrical system through which the engine-dependent operating variable initiates actuation of the throttle valve. This would require the whole concept to be adapted accordingly, but basically the idea of the invention described would be applicable in the same manner.

We claim:

1. In the method for starting a pressure-charged internal-combustion engine wherein at the beginning of the starting phase the engine receives combustion air via a bypass valve and during this time a throttle valve in a charge-air line from a pressure-charging device to the engine is closed, the improvement comprising the steps of initiating an opening operation of said throttle valve at the end of said starting phase by at least a pulse of a command variable corresponding to the temperature of the exhaust gases, and actuating said throttle valve to its open position by an engine-dependent operating variable, said throttle valve being maintained in said open position independently of the command variable by said engine-dependent operating variable until the engine is stopped.

2. The method as defined in claim 1 for starting a pressure-charged internal-combustion engine and which includes the further step of holding said throttle valve in its open position while the engine is running and independently of the value of said command variable.

3. In an apparatus for starting a pressure-charged internal-combustion engine wherein at the beginning of the starting phase the engine receives combustion air via a bypass valve and during this time a throttle valve in a charge-air line from said pressure charging device to the engine is closed the improvement comprising means producing a command variable corresponding to the temperature of the exhaust gases for initiating an opening operation of said throttle valve at the end of said starting phase, an initial control device actuated by said command variable, means responsive to an engine-dependent operating variable for actuating said throttle valve to its open position, and a final control device for controlling the operation of said throttle valve actuating means, said throttle valve being maintained in said open position independently of the command variable by said engine-dependent operating variable until the engine is stopped.

4. Apparatus as defined in claim 3 for starting a pressure-charged internal-combustion engine wherein said means responsive to said engine-dependent operating variable for actuating said throttle valve to its open position includes a fluid type operating medium.

5. Apparatus as defined in claim 3 for starting a pressure-charged internal-combustion engine wherein said means responsive to said engine-dependent operating variable for actuating said throttle valve to its open position is of the electrical type.

6. Apparatus as defined in claim 3 for starting a pressure-charged internal-combustion engine wherein said initial control device includes a positioning device which functions in response to an increasing value of said command variable to actuate said final control device which includes a switching device that activates said throttle valve actuating means.

7. Apparatus as defined in claim 6 for starting a pressure-charged internal-combustion engine wherein while said engine is running, said switching device is held in the position in which said throttle valve is open independently of the value of said command variable and is held in that position by said engine-dependent operating variable until the latter falls below a specified minimum value subsequent to the starting phase.

8. Apparatus as defined in claim 7 for starting a pressure-charged internal-combustion engine wherein said switching device is mechanically joined to a holding device also actuated by said engine-dependent operating variable and which together with said switching device is returned to its original position by an opposing force when said engine-dependent operating variable falls below said specified minimum value.

9. Apparatus as defined in claim 8 for starting a pressure-charged internal-combustion engine wherein said means by which said throttle valve is actuated to its open position also functions to return said throttle valve to its closed position when said switching device returns to its initial position.

10. Apparatus as defined in claim 8 for starting a pressure-charged internal-combustion engine wherein said means responsive to said engine-dependent operating variable for actuating said throttle valve to its open position includes a fluid type actuating medium and wherein said holding device is also actuated by said fluid operating medium.

11. Apparatus as defined in claim 3 for starting a pressure-charged internal-combustion engine wherein said means responsive to said engine-dependent operating variable for actuating said throttle valve to its open position includes a fluid type actuating medium and a valve controlled by said variable for controlling the flow of said medium.

12. Apparatus as defined in claim 3 for starting a pressure-charged internal-combustion engine wherein said means responsive to said engine-dependent operating variable for actuating said throttle valve to its open position includes a fluid type actuating medium controlling a fluid-pressure responsive electrical switch which in turn controls the operation of said throttle valve actuating means.

13. Apparatus as defined in claim 3 for starting a presurre-charged internal-combustion engine wherein said means responsive to said engine-dependent operating variable for actuating said throttle valve to its open position includes a fluid type actuating medium, wherein said initial control device includes a positioning device which functions in response to an increasing value of said command variable to actuate said final control device which includes a switching device that controls the flow of said fluid actuating medium to said throttle valve actuating means and wherein a rapid vent valve is included in the flow path of said fluid actuating medium between said switching device and said throttle valve actuating means.

* * * * *